United States Patent [19]

Ito

[11] Patent Number: 4,557,234

[45] Date of Patent: Dec. 10, 1985

[54] METHOD AND SYSTEM FOR CONTROLLING IDLE SPEED IN AN INTERNAL COMBUSTION ENGINE

[75] Inventor: Toshimitsu Ito, Toyota, Japan

[73] Assignee: Toyota Jidosha Kabushiki Kaisha, Toyota, Japan

[21] Appl. No.: 607,306

[22] Filed: May 4, 1984

[30] Foreign Application Priority Data

May 10, 1983 [JP] Japan ..... 58-81189
May 10, 1983 [JP] Japan ..... 58-81190

[51] Int. Cl.[4] ..... F02D 5/00; F02D 9/02; F02M 3/00

[52] U.S. Cl. ..... 123/339; 123/585; 123/588; 123/179 G

[58] Field of Search ..... 123/339, 585, 588, 179 G

[56] References Cited

U.S. PATENT DOCUMENTS

| | | | |
|---|---|---|---|
| 4,191,051 | 3/1980 | Kawata et al. | 123/339 |
| 4,306,527 | 12/1981 | Kinugawa et al. | 123/339 |
| 4,377,150 | 3/1983 | Kitamura et al. | 123/588 |
| 4,378,768 | 4/1983 | Itoh et al. | 123/339 |
| 4,381,746 | 5/1983 | Miyagi et al. | 123/588 |
| 4,388,913 | 6/1983 | Grimm et al. | 123/588 |
| 4,392,467 | 7/1983 | Miyagi et al. | 123/339 |
| 4,397,275 | 8/1983 | Itoh et al. | 123/339 |
| 4,414,943 | 11/1983 | Nagase | 123/588 |
| 4,438,049 | 3/1984 | Ammons | 123/339 |
| 4,457,276 | 7/1984 | Ueda et al. | 123/339 |
| 4,479,471 | 10/1984 | Hasegawa et al. | 123/588 |
| 4,484,552 | 11/1984 | Kobayashi et al. | 123/588 |
| 4,498,436 | 2/1985 | Horiuchi | 123/588 |

FOREIGN PATENT DOCUMENTS

| | | | |
|---|---|---|---|
| 0008243 | 1/1983 | Japan | 123/339 |
| 0008248 | 1/1983 | Japan | 123/339 |

*Primary Examiner*—Raymond A. Nelli
*Attorney, Agent, or Firm*—Cushman, Darby & Cushman

[57] ABSTRACT

A bypass passage bypassing a throttle valve and communicating a portion upstream of the throttle valve with a portion downstream of the throttle valve is blocked when an engine speed is increased to the upper limit value or more of a predetermined range or the bypass passage is opened when the engine speed is decreased to the lower limit value or less of the predetermined range, whereby the engine speed during idling is controlled to a value within the predetermined range. An idle speed is stabilized by opening the bypass passage immediately after the start and during warm-up process, where the engine speed is particularly instable during idling. Furthermore, the period of time of opening or blocking the bypass passage is shortened in accordance with the increase in a difference between the upper or lower limit of the predetermined range and the engine speed, whereby the engine speed is controlled so as to be quickly to a value within the predetermined range.

23 Claims, 8 Drawing Figures

METHOD AND SYSTEM FOR CONTROLLING IDLE SPEED IN AN INTERNAL COMBUSTION ENGINE

BACKGROUND OF THE INVENTION

1. Field of the Invention

This invention relates to a method of and a system for controlling an idle speed in an internal combustion engine, and more particularly to a method of and a system for controlling an idle speed, in which a flowrate of air flowing through a bypass passage bypassing a throttle valve is controlled, to thereby control an engine speed to a target engine speed.

2. Description of the Prior Art

There has heretofore been the tendency of setting an idle speed at a low value in the internal combustion engines from the viewpoint of economizing the fuel consumption rate. In consequence, in the internal combustion engine being compact in size and light in weight, even if slight loads from the lighting of high beam lights and the driving of a motor fan and the like are applied during idling, the engine speed is decreased, resulting in an instable engine speed during idling. Furthermore, when a deposit adheres to the throttle valve due to the change with time, the engine speed is gradually decreased, whereby the engine speed during idling may become instable.

For this reason, there has been known a method, in which a bypass passage bypassing the throttle valve is provided, a flowrate of air flowing through this bypass passage is controlled when the throttle valve is fully closed, i.e., during the engine idling, to thereby control an engine speed to a target engine speed. An air flowrate control valve, the opening of which is controlled by a step motor, is mounted in this bypass passage, whereby the opening of the air flowrate control valve is controlled in accordance with an engine load and a shaft position, whereby a target air flowrate is fed to engine combustion chambers, the engine speed is controlled to the target engine speed or thereabout. In addition, during the operating conditions other than the full closing of the throttle valve, i.e., the operating conditions where the throttle valve is opened at a predetermined opening, the opening of the air flowrate control valve is held at a predetermined value, whereby the air-fuel mixture consisting of the air flowrate passing through the throttle valve, the air flowrate passing through the bypass passage and fuel injected from a fuel injection valve and fed to the combustion chambers of the engine is adapted to take a value in the neighborhood of the stoichiometric value.

However, in the conventional method as described above, since the opening of the air flowrate control valve is controlled by the step motor, there are presented such disadvantages that the control is complicated and the cost is raised.

SUMMARY OF THE INVENTION

The present invention has been developed to obviate the above-described disadvantages of the prior art and has as its first object the provision of a method of and a system for controlling an idle speed in an internal combustion engine, in which an idle speed is controlled under a simplified control where a bypass passage is opened or blocked.

When a variation in the idle speed is high, only the opening or blocking of the bypass passage may not quickly control the engine speed to a value within a predetermined range. For this reason, the present invention has as its second object the control of the engine speed quickly to a value within a predetermined range even when the variation in the idle speed is high.

Furthermore, the phenomenon, where the engine speed during idling becomes instable, is remarkable when the engine coolant temperature is in the neghborhood of 60°–80° C. and the engine oil temperature is low immediately after the start of the engine and during the warm-up process, and particularly when the frictional loss of the engine is high. In consequence, the present invention has as its third object holding the idle speed to be stable immediately after the start of the engine and during the warm-up process.

To achieve the above-described object, the invention contemplates that, when the engine speed during idling is increased to the upper limit value or more of the predetermined range, the bypass passage interconnecting an intake passage located upstream of a throttle valve to the intake passage located downstream of the throttle valve is blocked, and, when the engine speed is decreased to the lower limit value or less of the predetermined range, the bypass passage is opened, to thereby control the engine speed during idling to a value within the predetermined range. According to this invention, when the engine speed is decreased, an intake airflow is increased through the bypass passage to thereby increase the engine speed, and, when the engine speed is increased, the air flowrate flowing through the bypass passage runs out, to thereby decrease the engine speed. In consequence, according to this first invention, a simplified control, where the bypass is opened or blocked, can stabilize the idle speed.

The invention contemplates that, in the case where, when the engine speed is increased to the upper limit value or more of the predetermined range, the bypass passage interconnecting an intake passage located upstream of the throttle value to the intake passage located downstream of the throttle valve is blocked, and, when the engine speed is decreased to the lower limit value or less of the aforesaid predetermined value, the aforesaid bypass passage is opened, to thereby control the engine speed during idling to a value within the aforesaid predetermined range, a period of time from a time when the engine speed is increased to the upper limit value or more to a time when the bypass passage is blocked is shortened in accordance with a magnitude of a difference between the engine speed and the aforesaid upper limit value, and a period of time from a time when the engine speed is decreased to the aforesaid lower limit value or less to a time when the bypass passage is opened is shortened in accordance with a magnitude of a difference between the engine speed and the aforesaid lower limit.

With the arrangement according to this invention, such particular advantages can be offered that, since the bypass passage is opened or blocked to control the idle speed, the control is simplified, and, since the period of time for opening or blocking the bypass passage is shortened in accordance with the magnitude of the variation in the engine speed, the larger the magnitude of the variation in the engine speed from the predetermined range becomes, the shorter the period of time for returning to the engine speed within the predetermined range becomes.

Further, the invention contemplates that, when the engine speed is increased to the upper limit value or more of the predetermined range, the bypass passage interconnecting an intake passage located upstream of the throttle valve to the intake passage located downstream of the throttle valve is blocked, and, when the engine speed is decreased to the lower limit value or less of the predetermined range, the aforesaid bypass passage is opened, to thereby control the engine speed during idling to a value within the predetermined range, and, when a period of time from the start of the engine is within a predetermined period of time and, when the engine coolant temperature is decreased to a predetermined value or less, the bypass passage is opened. According to this invention, the intake air flowrate is increased through the bypass passage immediately after the start of the engine and during the warm-up process, to thereby increase the engine speed. In consequence, with the arrangement according to this invention, such particular advantages can be offered that, since the bypass passage is opened or blocked to control the idle speed, the control is simplified, and, since the bypass passage is opened immediately after the start of the engine and during the warm-up process, the idle speed immediately after the start of the engine and during the warm-up process, during both of which the idle speed tends to be remarkably instable, can be stabilized.

DETAILED DESCRIPTION OF THE INVENTION

Figure 1:
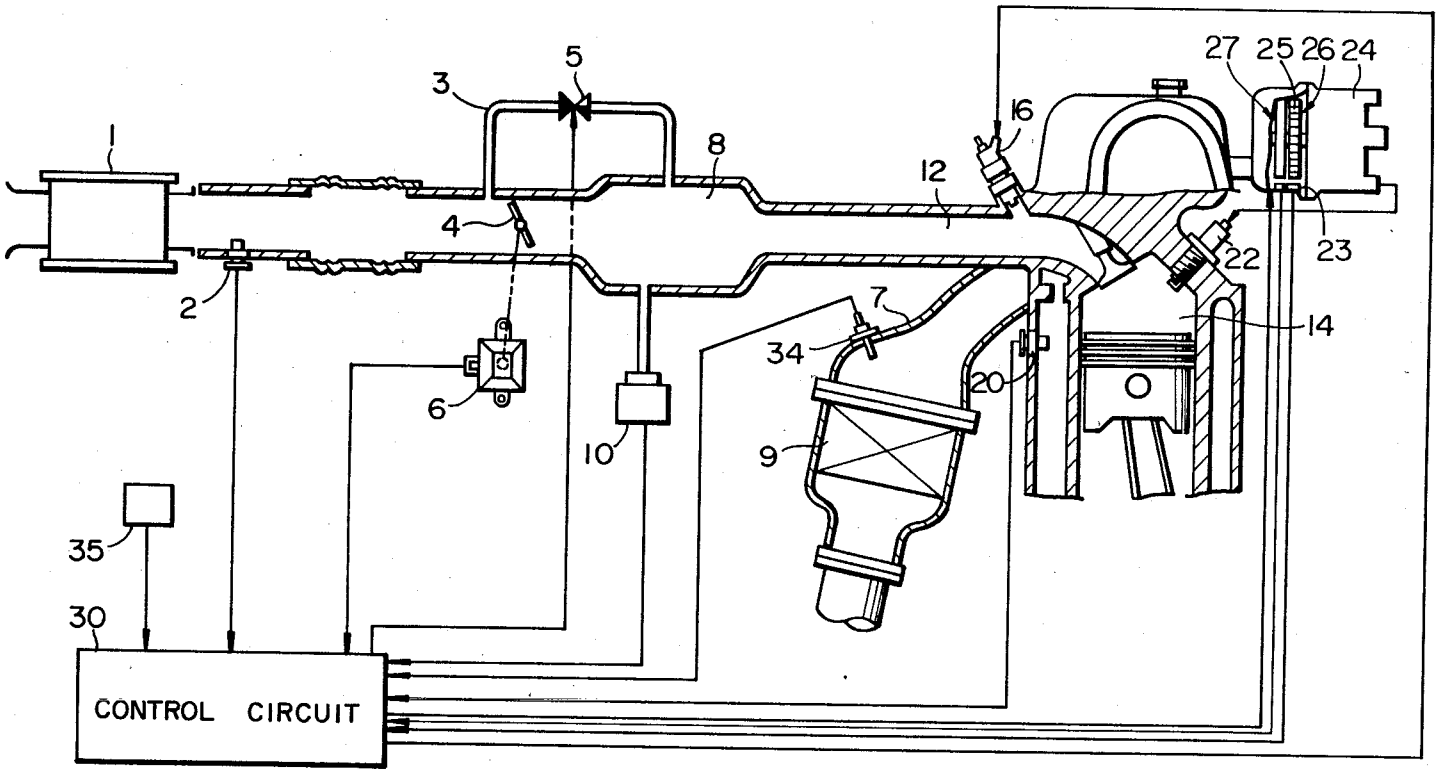
FIG. 1 is a schematic diagram showing an example of an internal combustion engine in one embodiment of the present invention.

Description will hereunder be given of embodiments of the present invention with reference to the drawings. As shown in FIG. 1, an intake air temperature sensor 2 for detecting the temperature of intake air and outputting an intake air temperature signal is mounted to a position downstream of an air cleaner 1. A throttle valve 4 is disposed downstream of the intake air temperature sensor 2, and a throttle switch 6 is provided which is operationally associated with the throttle valve 4 in a manner to be turned on when the throttle valve is fully closed and to be turned off when the throttle valve is opened. A surge tank 8 is provided downstream of the throttle valve 4. A pressure sensor 10 for detecting an intake pipe absolute pressure downstream of the throttle valve 4 and outputting an intake pipe pressure signal is mounted on this surge tank 8. A bypass passage 3 having one end thereof opened upstream of the throttle valve 4 and the other end thereof opened to the surge tank 8 is provided in a manner to bypass the throtle valve 4. An air control valve 5 for opening the bypass passage when opened and blocking the bypass passage when blocked is mounted in this bypass passage 3. As the air control valve 5, one which has such a small capacity that it can correct for the decrease of the idle speed due to an electric load, can be used. The surge tank 8 is communicated with combustion chambers 14 of the engine through an intake manifold 12. This intake manifold 12 is mounted thereon with fuel injection valves 16 for respective cylinders. Each of the combustion chambers 14 of the engine is communicated with a catalytic converter 9 filled up with a three-way catalyst through an exhaust manifold 7. Furthermore, an engine block is mounted thereon with a coolant temperature sensor 20 for detecting the coolant temperature of the engine and outputting a coolant temperature signal. The forward end of a spark plug 22 is projected into the combustion chamber 14, and a distributor 24 is connected to the spark plug 22. Mounted on the distributor 24 are an engine speed sensor 26 including a pickup 23 affixed to a distributor housing and a signal rotator 25 affixed to a distributor shaft, and a cylinder discriminating sensor 27. This engine speed sensor 26 outputs a crank angle signal at every 30°CA (crank angle) to a control circuit 30 for example. The cylinder discriminating sensor 27 outputs a cylinder discriminating signal at every 720°CA. In addition, designated at 34 is an $O_2$ sensor for detecting residual oxygen component in the exhaust gas and outputting an air-fuel ratio signal and 35 is a vehicle speed sensor for detecting a vehicle speed from the rotation of an output shaft at the final stage of a transmission, or the like.

Figure 2:
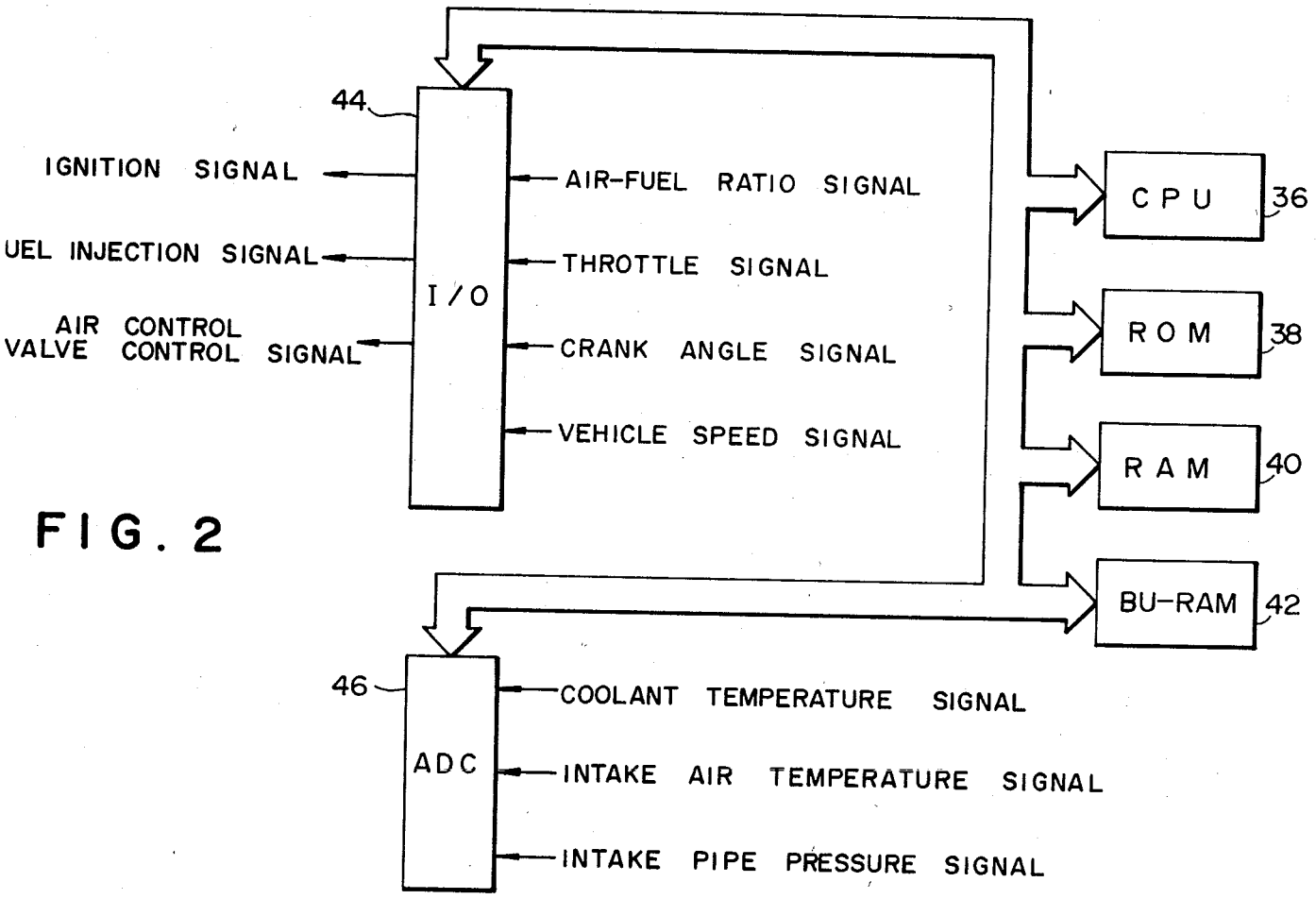
FIG. 2 is a block diagram showing a control circuit in FIG. 1.

As shown in FIG. 2, the control circuit 30 includes a central processing unit (CPU) 36, a read only memory (ROM) 38, a random access memory (RAM) 40, a back-up-RAM (BU-RAM) 42, an input/output port (I/O) 44, an analogue-digital converter (ADC) 46 and buses such as data bus and control bus, which connect the above-mentioned components to one another. Inputted to the I/O 44 are the vehicle speed signal, the crank angle signal, the air-fuel ratio signal and a throttle signal emitted from the throttle switch 6. Outputted through a drive circuit from the I/O 44 are an air control valve control signal for opening or closing the air control valve 5, a fuel injection signal for controlling the ON-OFF timing of the fuel injection valve 16 and an ignition signal for controlling the ON-OFF timing of an igniter. Inputted to the ADC 46 are the intake pipe pressure signal, the intake air temperature signal and the coolant temperature signal, all of which are successively converted into digital signals in response to the commands of the CPU 36.

The aforesaid crank angle signal is inputted to the I/O 44 through a waveform shaping circuit and a digital signal for representing an engine speed NE is formed by this crank angle signal. An ON-OFF signal (throttle signal) from the throttle switch 6 is sent into a predetermined bit position of the I/O 44 where it is temporarilly stored. Furthermore, the CPU 36 is provided with a first, a second and a third counters, in each of which an increment of count value is made at a predetermined time interval.

Description will hereunder be given of the routine in the first embodiment when the present invention is worked by use of the above-described engine. In explaining this embodiment, to avoid the complexity, the most convenient values of a plurality of types are represented. However, the present invention should not necessarily be limited to these numerical values, but the values most suitable for the engines of various types may be selected.

Figure 3:
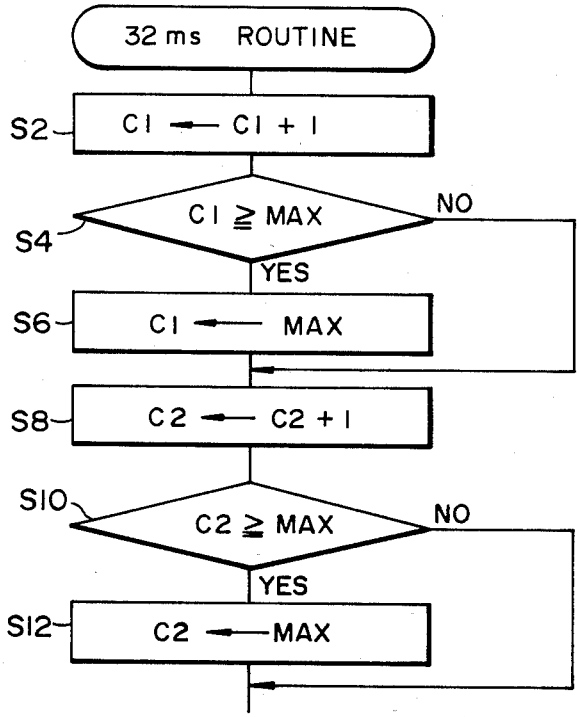
FIG. 3 is a flow chart showing an interruption routine for every 32 msec in a first embodiment of the present invention.

FIG. 3 shows the interruption routine carried out for every 32 msec and due to this interruption routine, an increment is made to the count value of each of the first and the second counters. In Step S2, a count value C1 of the first counter is increased by one increment, and in Step S8, a count value C2 of the second counter is increased by one increment. In Step S4, it is judged whether or not the count value C1 exceeds the maximum value MAX. If it exceeds the maximum value MAX, then, in Step S6, the count value C1 is changed into the maximum value MAX. Similarly, in Step S10, it is judged when or not the count value C2 exceeds the maximum value MAX. If it exceeds the maximum value MAX, then, in Step S12, the count value C2 is changed into the maximum value MAX. As the result, each of the count values in the first counter and the second counter is increased by one increment for every 32 msec and the count values are restricted to the maximum value, so that the overflow can be avoided.

Figure 4:
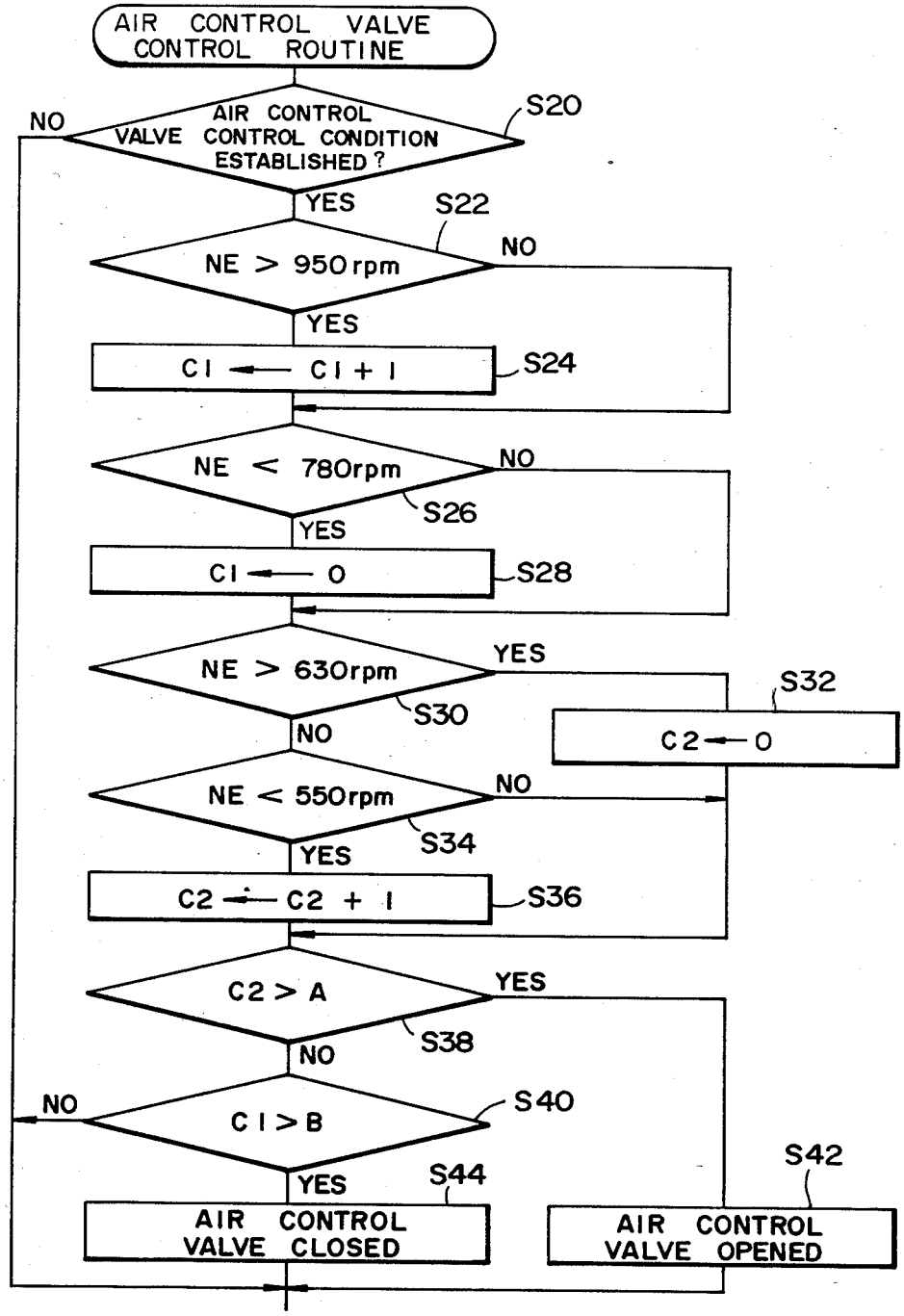
FIG. 4 is a flow chart showing a control routine of an air control valve in the first embodiment.

FIG. 4 shows the air control valve control routine carried out for every 32 msec. In Step S20, it is judged whether or not air control valve control condition is established, and, only when the control condition is established, the following Steps are followed. In addition, as the air control valve control condition for example, such condition can be adopted that the throttle switch 6 is on and the vehicle speed is 2.5 km/h or less.

In Step S22, it is judged whether or not the engine speed NE exceeds 950 r.p.m., and, only when the engine speed NE exceeds 950 r.p.m., the count value C1 of the first counter is increased by one increment in Step S24. In the subsequent Step S26, it is judged whether or not the engine speed NE is less than 780 r.p.m., and, only when the engine speed NE is less than 780 r.p.m., the first counter is cleared and the count value C1 is reset to zero.

In the subsequent Step S30, it is judged whether or not the engine speed NE exceeds 630 r.p.m. and, in Step S34, it is judged whether or not the engine speed NE is less than 550 r.p.m. Only, when the engine speed NE exceeds 630 r.p.m., the second counter is cleared and the count value C2 is reset to zero in Step S32, and only when the engine speed NE is less than 550 r.p.m., the count value C2 of the second counter is increased by one increment in Step S36.

As the results, the first counter and the second counter are cleared when the engine speed is within a predetermined range (630 r.p.m.$<$NE$<$780 r.p.m.). Furthermore, each of the count values of the first counter and the second counter is increased by one increment for every 32 msec by the routine shown in FIG. 3 in a first region (780 r.p.m.$\leqq$NE$\leqq$950 r.p.m.) where the engine speed is increased to the upper limit value or more of the predetermined range and in a second region (550 r.p.m.$\leqq$NE$\leqq$630 r.p.m) where the engine speed is decreased to the lower limit value or less of the predetermined range. Then, the count value of the first counter is increased by one increment for every 32 msec in Step S2 and also increased by one increment for every 32 msec in Step S24, in the third region (NE$>$950 r.p.m.) where the engine speed exceeds the first region, and increased by one increment for every 32 msec in Step S2. The count value of the second counter is increased by one increment for every 32 msec in Step S8 and also increased by one increment for every 32 msec in Step S36, in the fourth region (NE$<$550 r.p.m.) where the engine speed is less than that in the second region.

As the result that the count values of the counters are increased by increments as described above, the count value of each of the counters is increased by one increment for a shorter period of time in the third region than in the first region, i.e., a period of time shorter than 32 msec, and also for a shorter period of time in the fourth region than in the second region, i.e., a period of time shorter than 32 msec.

In the subsequent Step S38, it is judged whether or not the count value C2 of the second counter which has been increased by increments as described above exceeds a predetermined value (for example, 32), and, if the count value C2 exceeds the predetermined value A, then a control signal for opening the air control value 5 is outputted in Step S42. As the result, the bypass passage is opened. On the other hand, if the count value C2 is decreased to the predetermined value A or less, then it is judged whether or not the count value C1 of the first counter exceeds a predetermined value B (for example, 48) in Step S40, and, if the count value C1 exceeds the predetermined value B, then a control signal for closing the air control value 5 is outputted in Step S44. As the result, the bypass is blocked.

Figure 5:
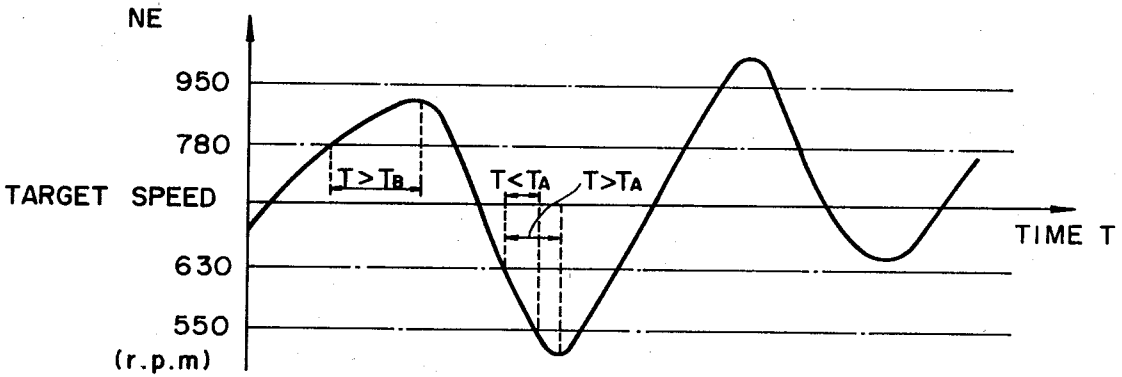
FIG. 5 is a chart showing a change in the engine speed against the time in the first embodiment.

Description will now be given of the change with time of the engine speed NE when the air control valve is opened or closed as described above, with reference to FIG. 5. When the engine speed is increased to 780 r.p.m. or more, the count value is increased by increments. If a time period T elapsing after the engine speed has reached 780 r.p.m. exceeds a time period $T_B$ corresponding to the predetermined value B, then the bypass passage is blocked, whereby no air flows through the bypass passage. As the result, the engine speed NE is lowered, and, if the engine speed is decreased to 630 r.p.m. or less, then the count value is increased by increments. Until the time period T elapsing after the engine speed has reached 630 r.p.m. exceeds a time period $T_A$ corresponding to the predetermined value A, the blocking of the bypass passage continues, and the engine speed is further lowered. If the engine speed is lowered to 550 r.p.m. or less, then the count value C2 of the second counter is further increased by increments in accordance with the routine shown in FIG. 4. When the time period T exceeds the time period $T_A$, the bypass passage is opened, and the flowrate of air passing through the bypass passage reaches the maximum value, whereby the engine speed is increased. In addition, when the engine speed is lowered to 550 r.p.m. or less, the count value C2 of the second counter is doubly increased by increments, the time period for opening the bypass passage is shortened. Furthermore, if such an arrangement is adopted that the count value of the second counter is increased by increments after a lapse of 16 msec upon the increase of counter value of the first counter by increments, the time period, during which the bypass passage is opened when the engine speed is 550 r.p.m. or less is shortened twice as much as the time period, during which the bypass passage is opened in the region of the engine speed ranging from 550 r.p.m. to 630 r.p.m.

As described above, according to this embodiment, the higher the value of decrease of the engine speed becomes, the faster the air is fed through the bypass passage, so that the lowering of the idle speed can be compensated. Furthermore, in an auto-transmission vehicle, the bypass passage is opened when the shift position is in a D (drive) range, so that the vibrations caused by the idling can be decreased.

Figure 7:
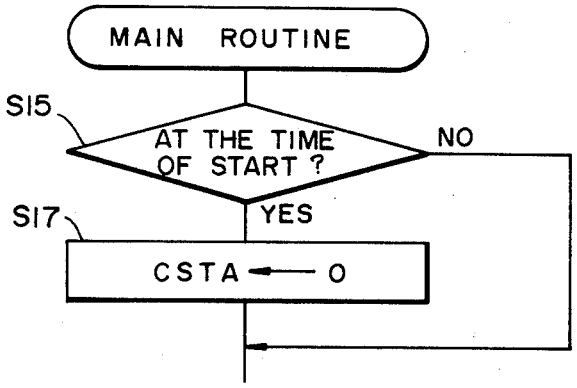
FIG. 7 is a chart showing a main routine in the second embodiment.
Figure 6:
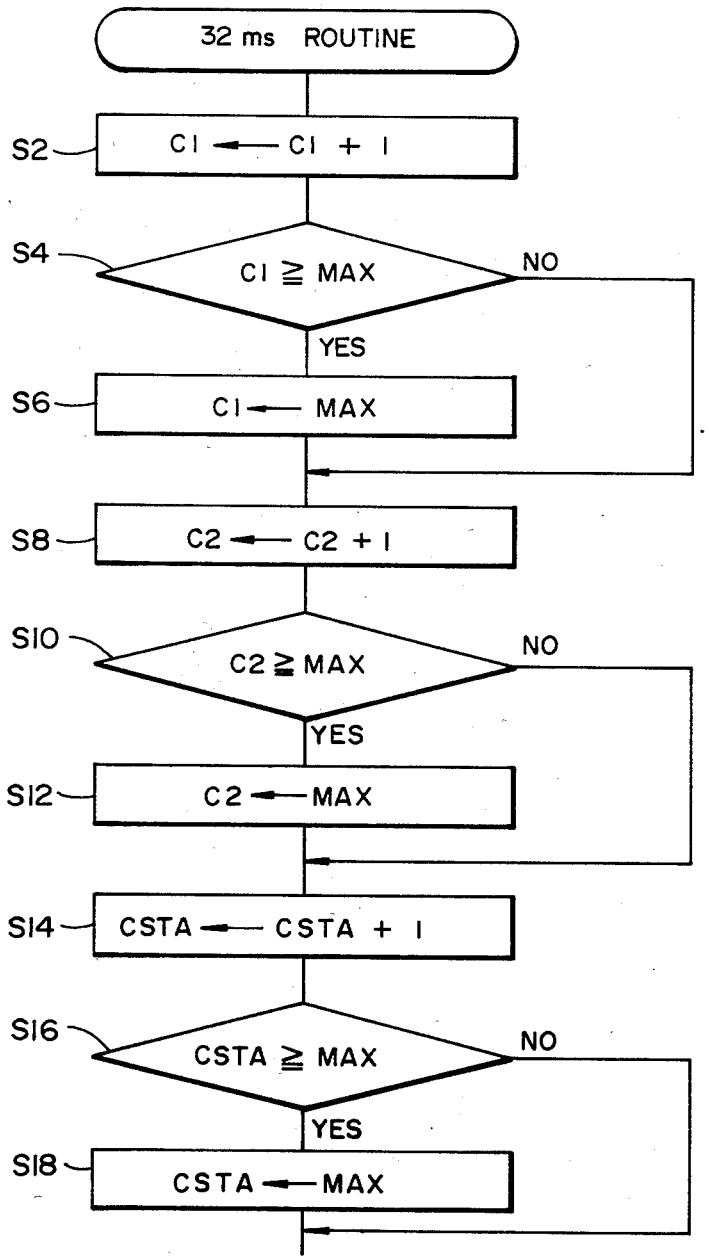
FIG. 6 is a chart showing an interruption routine for every 32 msec in a second embodiment.
Figure 8:
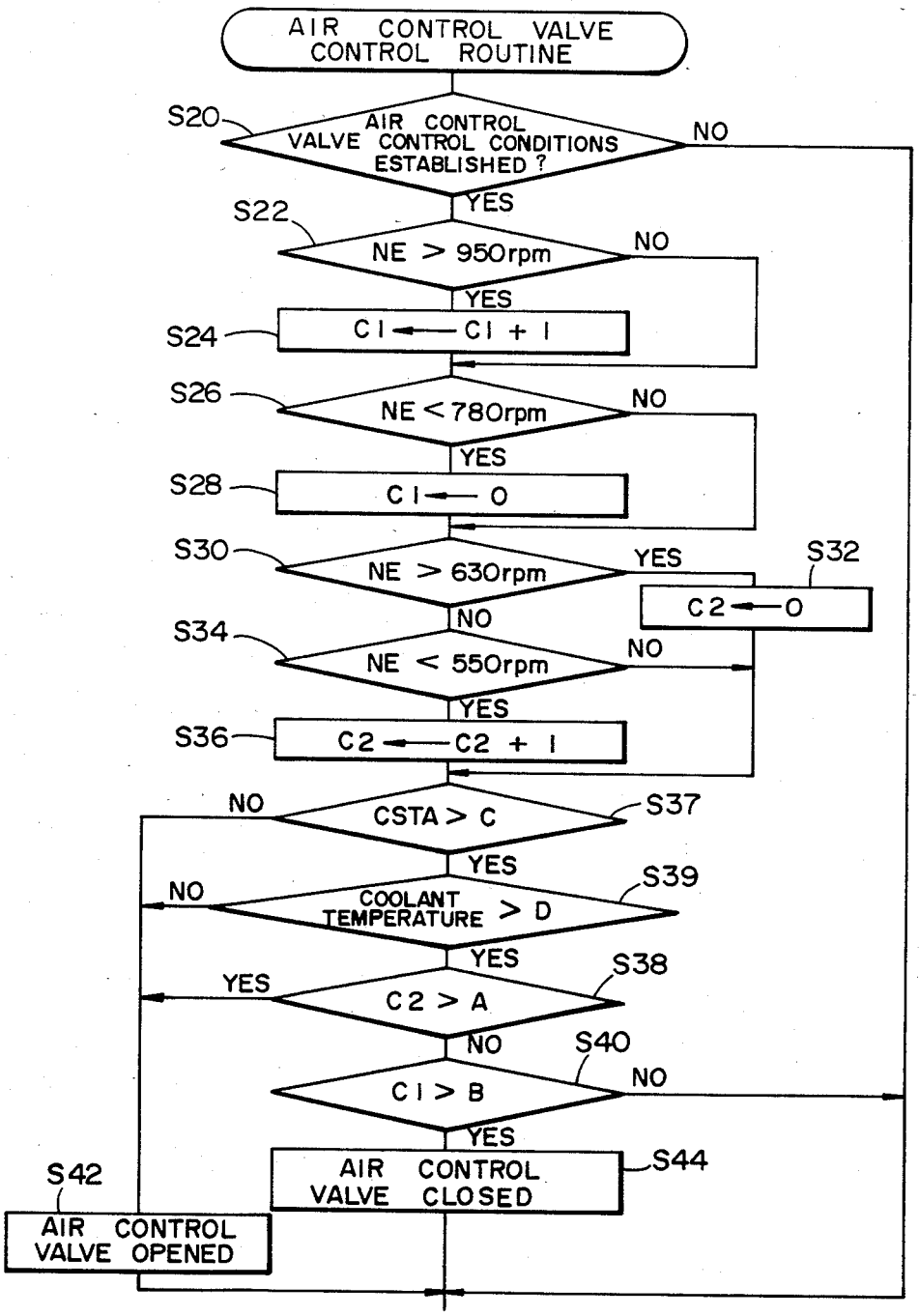
FIG. 8 is a chart showing a control routine of an air control valve in the second embodiment.

Description will hereunder be given of the routine in the second embodiment of the present invention with reference to FIGS. 6 to 8. This embodiment is obtained by combining another embodiment with the first embodiment described above. The routine shown in FIG. 6 indicates a routine similar to the interruption routine effected for every 32 msec in FIG. 3. In consequence, same reference numerals as shown in FIG. 3 are used in FIG. 6 to designate same or similar parts, so that detailed description will be omitted. The difference between the routines in FIG. 3 and in FIG. 6 resides in that Steps S14, S16 and S18 are added to the routine shown in FIG. 6.

In this embodiment, there is provided a third counter in addition to the first and the second counters in the first embodiment shown above. A count value CSTA of this third counter is increased by one increment in Step S14. And, in Step S16, it is judged whether or not the count value CSTA exceeds the maximum value MAX, and, if the count value CSTA exceeds the maximum value MAX, then the count value CSTA is changed to be the maximum value MAX. As the result, the respective counter are each increased by one increment for every 32 msec, and the count values are restricted to the maximum value MAX, so that the overflows can be avoided.

As shown in the main routine in FIG. 7, the above-mentioned third counter is cleared at the time of start. More specifically, in Step S15, it is judged whether it is the time of start or not, and, if it is the time of start, then the count value CSTA is reset to be zero in Step S17. Here, the time of start or not is judged by the engine speed. For example, the time of start includes a period of time, during which the engine speed is increased to 500 r.p.m. and a period of time, during which the engine speed is decreased to 300 r.p.m. or less. As the result, the third counter is counted from the time of start for every 32 msec.

FIG. 8 shows the air control valve control routine carried out for every 32 msec similarly to that shown in FIG. 4. In consequence, same reference numerals as shown in FIG. 4 are used to designated same or similar parts in FIG. 8, so that detailed description will be omitted. In FIG. 8, Steps S37 and S39 are inserted between Steps S36 and S38 as shown in FIG. 4.

In Steps S37 and S39, it is judged whether or not the count value CSTA of the third counter exceeds a predetermined value C (for example, a predetermined value within the range from 4 to 10 sec as converted into a time period) or whether or not the engine coolant temperature exceeds a predetermined temperature D (for example, a predetermined value in the vicinity of 65° C.–75° C.). When the count value CSTA is decreased to the predetermined value C or less, or the engine coolant temperature is decreased to the predetermined temperature or less, a control signal for opening the air control valve 5 is outputted in Step S42. As the result, the bypass passage is opened for a predetermined period of time from the time of start and during the warm-up process.

As described above, accordiing to this embodiment, the higher the value of decrease of the engine speed becomes, the faster the air is fed through the bypass passage, whereby the air is fed through the bypass passage immediately after the start and during the warm-up process, so that the decrease of the idle speed can be compensated. Furthermore, in the auto-transmission vehicle, the bypass passage is opened when the shift position is in the range, so that the vibration caused by the idling can be decreased.

In addition, FIG. 1 shows the engine, in which the basic fuel injection flowrate is determined by the intake pipe pressure and the engine speed, however, the application of the present invention need not necessarily be limited to the engine of this type. The present invention can be applied to an engine, in which the basic fuel injection flowrate is determined by the intake air flowrate per turn of the engine and the engine speed, and a carburetor type engine.

What is claimed is:

1. A method for controlling an idling rotational speed of an internal combustion engine provided with an air intake passage, a throttle valve therein and a bypass passage located upstream of the throttle valve to that located downstream thereof, wherein said idling rotational speed of the engine is controlled to be within a predetermined range, comprising the steps of:

sensing actual rotational speed of said engine;

counting for a time period beginning when engine rotational speed is increased to an upper limit value of said predetermined range to thereby establish a control parameter; and blocking completely said bypass passage in accordance with said time period.

2. A method as in claim 1, wherein said counting step includes increasing count rate when counting said time period in response to a differential increase between said actual rotational speed of said engine and said upper limit value of said predetermined range.

3. A method for controlling an idling rotational speed of an internal combustion engine provided with an air intake passage, a throttle valve therein and a bypass passage interconnecting the intake passage located upstream of the throttle valve to that located downstream thereof, wherein said idling rotational speed of the engine is controlled to be within a predetermined range, comprising the steps of:

sensing actual rotational speed and coolant temperature of said engine;

counting for a first time period beginning with starting of said engine to thereby establish a control parameter; and opening completely said bypass passage when one of the following conditions occurs: (a) said first time period is smaller than a predetermined time period, (b) said coolant temperature is lower than a predetermined temperature.

4. A method as in claim 3, further comprising the step of:

opening completely said bypass passage when said idling rotational speed of said engine is decreased beyond a lower limit value of said predetermined range.

5. A method as in claim 4, further comprising the step of:

blocking completely said bypass passage when said idling rotational speed of said engine is increased beyond an upper limit value of said predetermined range.

6. A method as in claim 4, further comprising the steps of:

counting for a second time period beginning when engine rotational speed is decreased beyond said lower limit value to thereby establish a control parameter; and opening completely said bypass passage in accordance with said second time period.

7. A method as in claim 5, further comprising the steps of:

counting for a third time period beginning when engine rotational speed increases beyond said upper limit value to thereby establish a control parameter; and blocking completely said bypass passage in accordance with said third time period.

8. A method as in claim 6, wherein said counting said second time period step includes increasing count rate when counting said second time period in response to a differential increase between said actual engine speed and said lower limit value of said predetermined range.

9. A method as in claim 7, wherein said counting said third time period step includes increasing count rate when counting said third time period in response to a differential increase between said actual engine speed and said upper limit value of said predetermined range.

10. A method for controlling an idling rotational speed of an internal combustion engine provided with an air intake passage, a throttle valve therein and a bypass passage interconnecting the intake passage located upstream of the throttle valve to that located downstream thereof, wherein said idling rotational speed of the engine is controlled to be within a predetermined range, comprising the steps of:

sensing actual rotational speed and coolant temperature of said engine;

counting for a first time period beginning with starting of said engine to thereby establish a control parameter;

opening completely said bypass passage when one of the following conditions occurs: (a) said first time period is smaller than a predetermined time period, (b) said coolant temperature is lower than a predetermined temperature; and blocking completely said bypass passage after said first time period is greater than said predetermined time period and said coolant temperature is higher than said predetermined temperature.

11. A method as in claim 10, further comprising the step of:

opening completely said bypass passage when said idling rotational speed of said engine decreases beyond a lower limit value of said predetermined range.

12. A method as in claim 11, further comprising the step of:

blocking completely said bypass passage when said idling rotational speed of said engine is increased beyond an upper limit value of said predetermined range.

13. A method as in claim 11, further comprising the steps of:

counting for a second time period beginning when said engine rotational speed is decreased beyond said lower limit value to thereby establish a control parameter; and opening completely said bypass passage in accordance with said second time period.

14. A method as in claim 12, further comprising the steps of:

counting for a third time period beginning when said engine rotational speed is increased beyond said upper limit value to thereby establish a control parameter; and blocking completely said bypass passage in accordance with said third time period.

15. A method as in claim 13, wherein said counting said second time period step includes increasing count rate when counting said second time period in response to a differential increase between said actual engine speed and said lower limit value of said predetermined range.

16. A method as in claim 14, wherein said counting said third time period step includes increasing count rate when counting said third time period in response to a differential increase between said actual engine speed and said upper limit value of said predetermined range.

17. A method for controlling an idling rotational speed of an internal combustion engine provided with an air intake passage, a throttle valve therein, and a bypass passage interconnecting the intake passage located upstream of the throttle valve to that located downstream thereof, wherein said idling rotational speed of the engine is controlled to be within a predetermined range, comprising the steps of:

sensing actual rotational speed of said engine;

counting for a time period beginning when engine rotational speed is decreased beyond a lower limit value of said predetermined range to thereby establish a control parameter; and opening completely said bypass passage in accordance with said time period.

18. A method as in claim 17, wherein said counting step includes increasing count rate when counting said time period in response to a differential increase between said actual engine speed and said lower limit value of said predetermined range.

19. A system for controlling an idling rotational speed of an internal combustion engine provided with an air intake passage, having a throttle valve therein, and a bypass passage interconnecting the intake passage located upstream of the throttle valve to that located downstream thereof, wherein said idling rotational speed of the engine is controlled to be within a predetermined range, comprising:

means for sensing actual rotational speed of said engine;

means for sensing coolant temperature of said engine;

means for counting a first time period beginning with starting of said engine to thereby establish a control parameter;

air control valve means for selectively completely opening and blocking said bypass passage; and control means for controlling said air control valve to open said bypass passage upon occurrence of one of the following conditions: (a) said first time period counted by said counting means being smaller than a predetermined time period, (b) said coolant temperature being lower than a predetermined temperature 20. A system as in claim 19, wherein said control means. includes means for controlling said air control valve to open said bypass passage completely when said idling rotational speed of said engine is decreased beyond a lower limit value of said predetermined range.

21. A system as in claim 20, wherein said control means includes means for controlling said air control valve to block said bypass passage completely when said idling rotational speed of said engine is increased beyond an upper limit value of said predetermined range.

22. A system as in claim 20, further comprising:

means for counting for a second time period beginning when said engine rotational speed exceeds either of said upper and lower limits to thereby establish a control parameter; and said control means includes means for controllably opening and blocking said bypass passage completely in accordance with said second time period.

23. A system as in claim 22, wherein said control means further includes means for increasing count rate when counting said second time period in response to a differential increase between said actual engine speed and one of said upper and lower limit values.

* * * * *